US012209812B2

(12) United States Patent
Heusser

(10) Patent No.: US 12,209,812 B2
(45) **Date of Patent: *Jan. 28, 2025**

(54) HEAT EXCHANGER FOR TEMPERING OF A FLUID

(71) Applicant: Promix Solutions AG, Winterthur (CH)

(72) Inventor: Rolf Heusser, Winterthur (CH)

(73) Assignee: Promix Solutions AG, Winterthur (CH)

( * ) Notice: Subject to any disclaimer, the term of this patent is extended or adjusted under 35 U.S.C. 154(b) by 42 days.

This patent is subject to a terminal disclaimer.

(21) Appl. No.: 17/723,628

(22) Filed: Apr. 19, 2022

(65) Prior Publication Data

US 2022/0357108 A1 Nov. 10, 2022

(30) Foreign Application Priority Data

May 10, 2021 (EP) ..... 21172934

(51) Int. Cl.

| | |
|---|---|
| ***F28D 7/16*** | (2006.01) |
| ***F28D 7/00*** | (2006.01) |
| ***F28D 15/02*** | (2006.01) |
| ***F28D 15/04*** | (2006.01) |

(Continued)

(52) U.S. Cl.

CPC ..... *F28D 7/0058* (2013.01); *F28D 7/0066* (2013.01); *F28D 7/1615* (2013.01); *F28D 15/0275* (2013.01); *F28D 15/046* (2013.01); *F28F 1/124* (2013.01); *F28F 3/022* (2013.01);

(Continued)

(58) Field of Classification Search

CPC ..... F28F 13/12; F28F 2210/10; F28D 7/0058; F28D 7/1615; F28D 7/0066

See application file for complete search history.

(56) References Cited

U.S. PATENT DOCUMENTS

| | | | | |
|---|---|---|---|---|
| 6,412,975 | B1 * | 7/2002 | Schuchardt | B01F 25/43161 366/337 |
| 8,573,289 | B1 | 11/2013 | Roper et al. | |
| 10,006,369 | B2 * | 6/2018 | Kupiszewski | F28D 7/10 |

(Continued)

FOREIGN PATENT DOCUMENTS

| | | |
|---|---|---|
| DE | 29618460 U1 | 9/1997 |
| DE | 19953612 A1 | 5/2001 |

(Continued)

OTHER PUBLICATIONS

EPO, European Search Report received in European Application No. 21172934.8, Oct. 18, 2021, 2 pgs.

*Primary Examiner* — Paul Alvare
(74) *Attorney, Agent, or Firm* — Hard IP LLC

(57) ABSTRACT

A heat exchanger for tempering of a fluid with a jacket element configured as a fluid channel for a fluid to be tempered and an insert element arranged in the fluid channel has web elements which are connected to the jacket element at different locations. Some of the web elements contain web element channels which are fluidly connected with the jacket element, so that in the operating state, a heat transfer fluid which is supplied to the jacket element can flow through the web elements. The jacket element contains chambers with one inlet opening and one outlet opening for a heat transfer fluid. The inlet opening and the outlet opening of the chambers are connected to the web element channels of two web elements each, which belong to the same row of web elements.

15 Claims, 3 Drawing Sheets

(51) Int. Cl.
*F28F 1/12* (2006.01)
*F28F 3/02* (2006.01)

(52) U.S. Cl.
CPC ..... *F28F 2255/18* (2013.01); *F28F 2260/02* (2013.01)

(56) References Cited

U.S. PATENT DOCUMENTS

2011/0185712 A1* 8/2011 Burns ..... F28D 7/1615 165/182
2012/0181006 A1* 7/2012 Angiolini ..... F28D 7/1615 165/173
2014/0245717 A1* 9/2014 Vuillamy ..... F28F 9/22 60/260
2015/0083375 A1* 3/2015 Heusser ..... F28F 13/125 29/890.03
2015/0087733 A1* 3/2015 Heusser ..... B29C 48/385 521/79
2018/0328673 A1* 11/2018 Stoia ..... F28D 1/05366
2019/0024987 A1* 1/2019 Moore ..... F28F 3/02
2019/0054676 A1* 2/2019 Heusser ..... B29C 48/9115
2019/0093954 A1* 3/2019 Jensen ..... F28F 1/022
2019/0162490 A1* 5/2019 Heusser ..... B01F 25/431
2021/0270534 A1* 9/2021 Erno ..... F28D 7/005

FOREIGN PATENT DOCUMENTS

EP 0004081 A2 9/1979
EP 1123730 A2 8/2001
EP 1967806 A1 9/2008
EP 2851118 A1 3/2015
EP 3431911 A1 1/2019
EP 3444097 A2 2/2019
EP 3489603 A1 5/2019
EP 3822569 A1 5/2021
WO 2018023101 A1 2/2018

* cited by examiner

HEAT EXCHANGER FOR TEMPERING OF A FLUID

CROSS-REFERENCE TO RELATED APPLICATIONS

This application claims the benefit of European patent application no. EP 21172934.8, filed May 10, 2021, the contents of which is incorporated herein by reference in its entirety.

TECHNICAL FIELD

The invention relates to a heat exchanger for tempering of a fluid. The heat exchanger includes a jacket element and an insert element. The jacket element of the heat exchanger is configured to receive a heat transfer fluid. The jacket element forms a peripherally closed fluid passage for a fluid which flows through the heat exchanger when in use and is heated or cooled by the heat exchange with the jacket element. To improve heat transfer, such a jacket element is often configured as a double jacket. The double jacket represents a chamber through which a heat transfer fluid can flow.

DESCRIPTION OF RELATED ART

For example, document EP3444097 A2 shows a cooling element and a mixing element for a plastic melt. The plastic melt is mixed by means of the previously known mixing element and the plastic melt is cooled by means of the cooling element. The cooling element is provided with a double jacket in order to cool the wall flow, i.e., the plastic melt flowing near the inner wall of the jacket element. When the plastic melt hits the mixing element, which protrudes into the core flow and has a corresponding guide element for this purpose, the wall flow and the core flow can be mixed with one another. The plastic melt flowing along the wall is deflected by the guide element in such a way that it is introduced into the core flow, which enables a heat exchange between the cooled wall flow and the core flow.

If the heat transfer via the double jacket is not sufficient for tempering of the fluid, webs can be provided, as shown in EP 2851118 A1, through which the heat transfer fluid located in the double jacket can flow. The webs are arranged in such a way that they traverse the fluid channel. The webs contain channels for the heat transfer fluid, which are in fluid communication with the chamber formed by the double jacket. It has been found that the heat transfer between the fluid and the heat transfer fluid can be improved with these webs. In addition, a mixing effect can be achieved by means of the webs, which means that, for example, a fluid consisting of several components can also be mixed through the webs configured as a mixer insert, which improves the mixing effect compared to conventional tube bundle heat exchangers, for example according to DE 199 53 612 A1. Such web elements are also used in EP 3 489 603 A1. Cooling channels in the form of tubes with a circular cross-section according to WO2018/023101 A1 or EP 1 123 730 A2 or in the form of tubes with a square cross-section according to DE 296 18 460 U1 or in the form of cooling channels with a zigzag-like cross-sectional shape according to EP 0 004 081 A2 can be provided for the cooling of bulk materials. It is also known from EP 3 431 911 A1 to arrange multiply branched hollow structures consisting of pipe sections in a pipe. A heat transfer fluid, for example oil, flows through the hollow structures, and a compressible fluid, for example air, flows around the hollow structures.

In all previously known solutions, which show web elements or tubes through which fluid flows, the heat transfer fluid is distributed to the web elements or tubes via a distribution channel and passes from the web elements or tubes into a collection channel. The distribution channel thus contains only a single inlet and the inlet openings for the web elements, the collection channel contains all the outlet openings of the web elements and a single outlet. However, it has been shown that the heat transfer fluid flowing through the web elements or tubes flows through the webs at very different speeds. Due to the design, the inlet openings of the web elements are arranged in the distribution channel at different distances from the inlet. Due to the design, the outlet openings of the web elements are arranged in the collection channel at different distances from the outlet. Due to the structural arrangement of the inlet openings in the distribution channel and the outlet openings in the collection channel, different flow speeds result for the heat transfer fluid. Therefore, with an increase in the number of web elements, as shown for example in EP 1 123 730 A2, or an increase in the cross section of the web elements through which fluid flows, as disclosed in EP 0 004 081 A2, a further improvement in heat transfer cannot necessarily be achieved because the design-related different distances and thus the different flow velocities are maintained even with an increase in the web elements or an increase in the cross section of the web elements through which fluid flows.

It is therefore the object of the invention to ensure that as far as possible all chambers and the web element channels are evenly flowed through by the heat transfer fluid. In addition, the object of the invention is to keep the pressure loss of the heat transfer fluid flowing through the web elements as low as possible or to reduce it to the lowest possible value in order to reduce energy costs for conveying means and/or pressure-increasing means, for example for pumps.

SUMMARY OF THE INVENTION

The object of the invention is achieved by a heat exchanger according to claim 1. Advantageous variants of the heat exchanger are the subject of claims 2 to 11. A method for tempering of a fluid by means of a heat exchanger with the features of claim 1 is the subject of claim 12. Advantageous method variants are subject of claims 13 to 15.

When the term "for example" is used in the following description, this term refers to exemplary embodiments and/or embodiments, which is not necessarily to be construed as a more preferred application of the teachings of the invention. Similarly, the terms "preferably", "preferred" should be understood as referring to one example from a set of exemplary embodiments and/or variants, which should not necessarily be construed as a preferred application of the teachings of the invention. Accordingly, the terms "for example," "preferably," or "preferred" may refer to a plurality of exemplary embodiments and/or variants.

The following detailed description contains various exemplary embodiments for a heat exchanger. The description of a particular heat exchanger is to be considered as an example only. In the specification and claims, the terms "include", "comprise", "have" shall be interpreted as "including but not limited to".

If the term "fluid" is used in the following description, this term also stands for "flowable medium" or "fluid mixture".

The object of the invention is achieved by a heat exchanger which comprises a jacket element and an insert element, with the jacket element being configured as a fluid channel for a fluid to be tempered. The insert element is arranged in the fluid channel. The insert element includes a plurality of web elements connected to the jacket element at different locations. The web elements are arranged in at least a first row of web elements and a second row of web elements. The web elements of each of the first and second rows of web elements are arranged substantially parallel to one another. The angles which the web elements of different rows of web elements enclose with the longitudinal axis of the jacket element differ. At least some of the web elements contain web element channels which are in fluid-conducting connection with the jacket element, so that in the operating state a heat transfer fluid which is supplied to the jacket element can flow through the web element channels of the web elements. The jacket element contains a plurality of chambers for the heat transfer fluid, each of the chambers containing at least one inlet opening and at least one outlet opening for the heat transfer fluid or being configured as a distribution chamber or as a collection chamber. The inlet opening and the outlet opening of the chamber are connected to the web element channels of two web elements each, which belong to the same row of web elements if the chamber is not configured as a distribution chamber or collection chamber. In particular, the web element channels of the web elements of a row of web elements which are adjacent to one another, are fluidly connected via the corresponding chamber.

The web elements can be arranged in at least two sets of web elements, the web elements of each set of web elements being arranged essentially parallel to one another. The angles which the web elements of different sets of web elements enclose with the longitudinal axis of the heat exchanger differ at least in part. At least some of the web elements contain the web element channels, which are in fluid-conducting connection with the jacket element, so that in the operating state a heat transfer fluid, which is supplied to the jacket element, can flow through the web element channels of the web elements. At least one of the chambers can contain a plurality of inlet openings and at least two outlet openings or a plurality of outlet openings and at least two inlet openings for the heat transfer fluid. Thus, at least part of the chambers can contain a plurality of inlet openings and outlet openings. According to an embodiment, at least one of the chambers contains a single inlet opening and a single outlet opening for the heat transfer fluid. Thus, at least a portion of the chambers may contain a plurality of inlet openings and outlet openings and a portion of the chambers may contain a single inlet opening and a single outlet opening.

In particular, at least a first and a second set of web elements can be provided. The first set of web elements contains the web elements of the first rows of web elements, the center axes of which span a common first web element plane. The second set of web elements contains the web elements of the second rows of web elements, the center axes of which span a common second web element plane. The first web element plane is arranged in particular at a first set angle of −30 degrees up to and including −75 degrees to the longitudinal axis. The second web element plane is arranged in particular at a second set angle of 30 degrees up to and including 75 degrees to the longitudinal axis. The web elements of the first set of web elements are aligned parallel to one another, that is to say the web elements of the first set of web elements have the same alignment with respect to one another. The web elements of the second set of web elements are aligned parallel to one another, that is to say the web elements of the second set of web elements have the same alignment with respect to one another. The alignment of the web elements of the first set of web elements differs from the alignment of the web elements of the second set of web elements. According to the embodiments shown in FIGS. 1*a*, 1*b*, 2, and 3, eight first sets of web elements and eight second sets of web elements are shown.

Of course, any number of first sets of web elements and second sets of web elements can be provided. Each of the first and second sets of web elements may contain a different number of web elements. The number of web elements of each set of web elements can in particular be at least two. Of course, more than two sets of web elements can be provided, with the web elements of each of the sets of web elements having the same orientation amongst each another but having a different orientation with respect to the web elements of each other set of web elements. For example, the web elements of three sets of web elements can be aligned according to FIG. 10 of EP 1 123 730 A2.

According to an embodiment, the inlet openings and the outlet openings, which are located in the same chamber, belong to web elements of different sets of web elements. The distance covered by the fluid between the inlet opening and the nearest outlet opening in the same chamber corresponds to the distance between two inlet openings of adjacent unidirectional sets of web elements. Inlet openings and outlet openings of different sets of web elements can be combined in a common chamber if they belong to rows of web elements whose web elements are aligned parallel to one another.

In particular, the jacket element can contain an inlet for the heat transfer fluid. In particular, the jacket element can contain an outlet for the heat transfer fluid. According to an embodiment, at least some of the chambers can be at least partially separated from one another by partition walls.

According to an embodiment, each of the chambers is fluidly connected via the web element channels with at least one further chamber for the heat transfer fluid. In particular, the inlet openings and/or outlet openings of different chambers can be at least partially connected to one another via web elements that pass through the fluid channel. According to this embodiment, at least a portion of the heat transfer fluid flows sequentially through a number of mixing chambers. The heat transfer fluid can be remixed and distributed in each of the chambers, which are provided with multiple inlet openings and multiple outlet openings. In particular, it is possible for the heat transfer fluid in the distribution chamber and the collection chamber to flow transversely with respect to the direction of flow of the fluid.

According to an embodiment, each of the chambers can extend over a portion of the circumference of the jacket element. Thus, several chambers can be arranged side by side on the circumference of the jacket element. In particular, the length of the chamber can be greater than its width. According to an embodiment, the width of the chamber can be at most half the length of the chamber. According to this embodiment, the length of the chamber is measured parallel to the longitudinal axis of the heat exchanger. The width of the chamber is measured in a plane normal to the longitudinal axis of the heat exchanger. In this context, a normal plane is a plane which is arranged at a right angle, that is to say at an angle of 90 degrees, to the longitudinal axis of the heat exchanger. The width may be measured along a straight line when the heat exchanger is rectangular. The width of the chamber can also be measured along a line of curvature, for example in the form of a segment of a circle if the heat exchanger is configured as a cylinder.

According to an embodiment, at least some of the web elements are oriented at an angle other than 90 degrees to the longitudinal axis of the heat exchanger. The longitudinal axis of the heat exchanger corresponds to the main direction of flow of the fluid. In particular, the angle of the web elements can differ from one another, in particular at least a first web element can be arranged crosswise to a second web element.

Each of the chambers can have a length and a width and a height. The length of the chamber is its dimension parallel to the direction of flow of the fluid, i.e., parallel to the longitudinal axis of the heat exchanger. The width of the chamber corresponds to the dimension transverse to the direction of flow of the fluid, i.e., the dimension of the chamber measured in a plane perpendicular to the longitudinal axis of the heat exchanger. In other words, the perpendicular plane is arranged at right angles to the longitudinal axis of the heat exchanger. The height of the chamber corresponds to the distance between the outer wall of the jacket element and the inner wall of the jacket element. The ratio of the width of a chamber to the length of the chamber can be in the range from 0.1 up to and including 0.5. In other words, according to this embodiment, the length of the chamber is twice up to and including 10 times greater than its width. The chambers can be formed, for example, as recesses in the jacket element. The chambers can also be configured as superstructures of the jacket element. The chambers can be manufactured by metal casting.

According to an embodiment, the inlet openings and the outlet openings, which are located in the same chamber, belong to web elements of different sets of web elements. According to an embodiment, at least four first rows of web elements and four second rows of web elements are arranged side by side. For example, the at least four first rows of web elements and the at least four second rows of web elements can be arranged in the fluid channel, so that the fluid can flow around them in the operating state. In particular, the same number of first rows of web elements as second rows of web elements can be provided.

According to an embodiment, at least one of the first or second rows of web elements contains at least ten web elements. The web elements of one of the first or second rows of web elements are in particular connected to the chambers in such a way that the heat transfer fluid can flow through the chambers and the web element channels of the associated first or second row of web elements sequentially, i.e., one after the other, in the operating state. The chambers and the web element channels of the associated first or second row of web elements are thus flown through in series.

A method for tempering a fluid comprises tempering the fluid by means of a heat exchanger, the heat exchanger comprising a jacket element and an insert element, wherein the fluid flows in a fluid channel enclosed by a jacket element. The insert element is arranged in the fluid channel and the insert element contains a plurality of web elements which are connected to the jacket element at different locations. The web elements are arranged in at least a first row of web elements and a second row of web elements, wherein the web elements of each of the first rows of web elements and the second rows of web elements are arranged essentially parallel to one another. The angles which the web elements of different rows of web elements enclose with the longitudinal axis of the heat exchanger differ at least in part. At least some of the web elements contain web element channels which are fluidly connected with the jacket element, so that in the operating state a heat transfer fluid which is supplied to the jacket element can flow through the web element channels of the web elements. The jacket element contains a plurality of chambers for a heat transfer fluid, wherein each of the chambers contains at least one inlet opening and at least one outlet opening for the heat transfer fluid, so that the heat transfer fluid flows through each of the chambers and the web element channels.

In particular, the inlet openings and/or outlet openings of different chambers can be connected to one another via web elements that traverse the fluid channel, so that a heat transfer takes place between the heat transfer fluid and the fluid via the inner wall of the jacket element and the web elements when the heat transfer fluid passes through the chambers and the web element channels of the web elements. According to different variants of the method, the heat transfer fluid flows through the chambers and/or the web element channels in the direction of flow of the fluid and/or counter to the direction of flow of the fluid. If necessary, a distribution chamber, a collection chamber or a deflection chamber can be provided, in which the heat transfer fluid can flow transversely to the direction of flow of the fluid. According to a variant of the method, the heat transfer fluid flows from an outlet opening of one of the chambers to an inlet opening in the respective subsequent chamber through one of the web element channels, which is arranged in one of the web elements, which is arranged in the fluid channel, so that the heat transfer fluid flows through the chambers sequentially, i.e., the fluid flows through one chamber after the other chamber.

According to a variant of the method, the heat transfer fluid flows from an outlet opening of one of the chambers to an inlet opening in the respective subsequent chamber through one of the web element channels, which is arranged in one of the web elements, which is arranged in the fluid channel, so that the heat transfer fluid flows through the web element channels of the web elements of the row of web elements sequentially.

According to a variant of the method, the heat transfer fluid can flow in the chamber essentially along the connecting line between the midpoints of the inlet openings leading into the chamber and the outlet openings leading out of the chamber, with the connecting line being arranged at an angle to the center axis of the web element channel, the angle being in the range from 30 degrees up to and including 160 degrees. In particular, the heat transfer fluid can flow in the web element channels in the direction of flow or counter to the direction of flow of the fluid.

The invention thus relates to a heat exchanger which can be produced inexpensively and which can also be used as a static mixer or a static mixer which can also be configured as a heat exchanger at the same time or can include the function of a heat exchanger. The heat exchanger is suitable in particular for cooling or heating fluids, with the fluids being able to include, for example, viscous or highly viscous fluids, in particular polymers. If such a device is used for processing highly viscous fluids, for example polymer melts, the static mixers used there typically have to withstand nominal pressures of 50 up to and including 400 bars and temperatures of 50 up to and including 300 degrees Celsius.

Heat exchangers are used in many areas of the processing industry. According to an embodiment, a fluid can be moved over at least one stationary insert element. The insert element typically includes internal elements that cause a deflection of the fluid flow that is directed through the interior of the insert element, which is bounded by an insert element jacket element. A heat transfer fluid flows through the internal elements. The fluid flowing through the insert element generates a pressure gradient. The pressure gradient can be generated, for example, by using pumps.

BRIEF DESCRIPTION OF THE DRAWINGS

The heat exchanger according to the invention is illustrated below according to some exemplary embodiments.

It is shown in FIG. 1*a* a view of a heat exchanger according to a first embodiment, FIG. 1*b* a variant of the heat exchanger according to FIG. 1*a* in a sectional view, FIG. 2 a view of a heat exchanger according to a second embodiment, FIG. 3 a view of a heat exchanger according to a third embodiment.

DETAILED DESCRIPTION

Figure 1A:
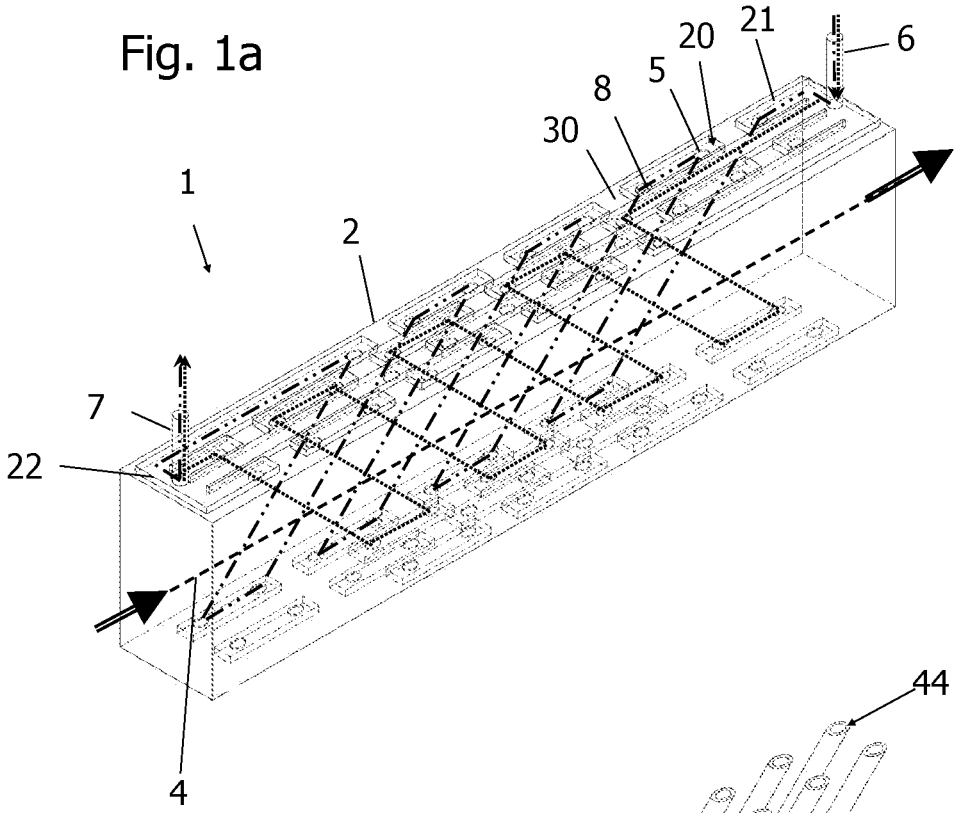
Figure 1A:
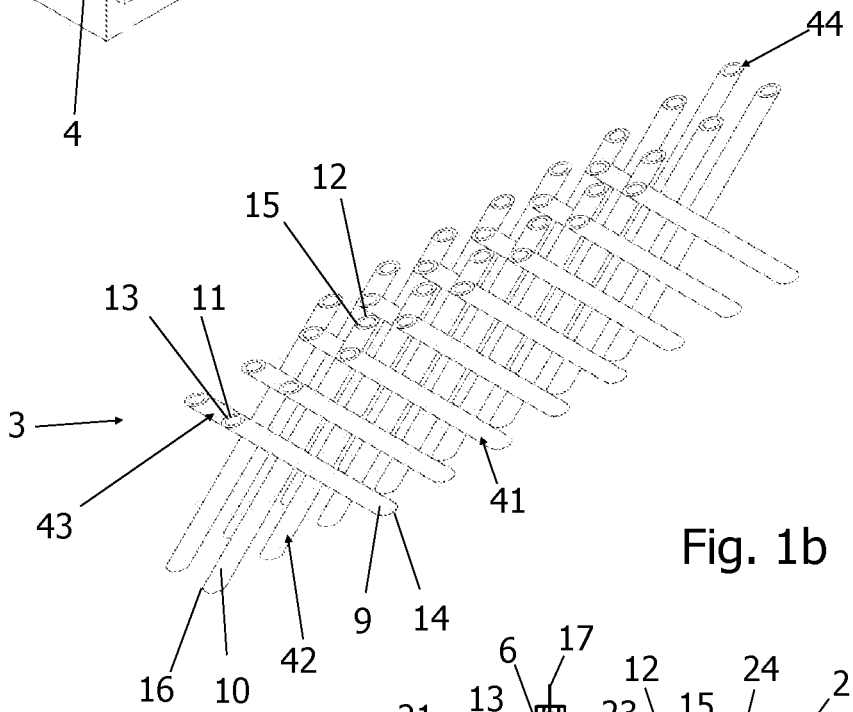

FIG. 1*a* shows a view of a heat exchanger 1 according to a first embodiment of the invention. The heat exchanger according to FIG. 1*a* comprises a jacket element 2 and an insert element 3. The insert element 3 and the jacket element 2 are drawn separately from one another; in the assembled state, the insert element 3 is located inside the jacket element 2. In this illustration, the jacket element 2 is shown as a transparent component so that all the jacket element channels located in the jacket element 2 are visible. The heat exchanger 1 for static mixing and heat exchange according to FIG. 1*a* thus contains a jacket element 2 and an insert element 3, wherein the insert element 3 is arranged inside the jacket element 2 in the installed state. The jacket element 2 is designed as a hollow body. The insert element 3 is accommodated in the jacket element, that is to say in the hollow body. The jacket element 2 has a longitudinal axis 4 which extends essentially in the main direction of flow of the fluid which flows through the jacket element 2 in the operating state. A possible direction of flow of the fluid is represented by arrows running in the direction of the longitudinal axis 4. The longitudinal axis 4 runs through the center point of the opening cross section of the jacket element. According to the present illustration, the jacket element 2 has a rectangular opening cross section. The longitudinal axis 4 thus runs through the intersection of the diagonals of the rectangle.

The insert element 3 contains a plurality of web elements 9, 10. According to the present embodiment, the web elements 9 and the web elements 10 have a different angle of inclination in relation to the longitudinal axis 4. According to the present embodiment, a plurality of web elements 9 are arranged one behind the other in the direction of flow of the fluid and form a first row of web elements 41. A plurality of web elements 10 are arranged one behind the other in the direction of flow of the fluid and form a second row of web elements 42. For the sake of simplicity, reference numerals 9, 10 designate only one of each of the web elements of the corresponding first or second row of web elements 41, 42. An insert element 3 can comprise a plurality of first and/or second rows of web elements 41,42. The insert element 3 shown contains two first rows of web elements 41, 43 and two second rows of web elements 42, 44. According to an embodiment that is not shown, a single first and second row of web elements can be provided. The number of first and second rows of web elements can also be greater than one or two. According to the present embodiment, the first row of web elements 41 is arranged next to the second row of web elements 42. The first row of web elements 43 is arranged next to the second row of web elements 44. The orientation of the web elements 9 of each first row of web elements 41, 43 thus changes in relation to the orientation of the web elements 10 of the respective adjacent second row of web elements 42, 44.

Each of the web elements 9 has a first end 13 and a second end 14, wherein the first end 13 and the second end 14 of the web element 9 are connected to the jacket element 2 at different locations. The web element 9 contains a web element channel 11. The web element channel 11 is only partially shown in the present illustration. Each of the web elements 10 has a first end 15 and a second end 16, wherein the first end 15 and the second end 16 of the web element 10 are connected to the jacket element 2 at different locations. The web element 10 contains a web element channel 12. The web element channel 12 is only partially shown in the present illustration. Such web element channels 11,12 are already known from EP 2851118 A1 and EP 3489603 A1 or the European patent application EP 20207057.9 published as EP3822569 A1. The webs disclosed in these documents are to be regarded as examples of a large number of other possible web shapes. The jacket element according to the invention can be used for any number, arrangement or shape of the web elements. The web element channel 11 extends from the first end 13 of the web element 9 to the second end 14 of the web element 9. The web element channel 12 extends from the first end 15 of the web element 10 to the second end 16 of the web element 10. The web elements 9 can be arranged crosswise to the web elements 10. The web elements 9 can be arranged in a first angle of inclination in relation to the longitudinal axis 4. The web elements 10 can be arranged in a second angle of inclination in relation to the longitudinal axis 4.

The jacket element 2 contains at least one inlet 6 and one outlet 7 for a heat transfer fluid which flows through the heat exchanger in the operating state. The jacket element 2 is at least partially configured as a hollow body, for example as a double jacket. A plurality of chambers 20 are located in the interior of the jacket element 2. These chambers 20 are flowed through by the heat transfer fluid in the operating state. The course of flow of the heat transfer fluid through the jacket element 2 and the insert element 3 within the web element channels 11, 12 is shown in the present illustration by dash-dotted lines with two dots between two adjacent dashes as well as by dashed lines. The double jacket can be formed by an outer shell and an inner shell. The chambers 20 may be formed by partition walls extending between the outer shell and the inner shell. The chambers 20 can also be configured as recesses in the jacket element 2. Alternatively or in combination with the aforementioned embodiments, the chambers 20 can be configured as superstructures of the jacket element 2.

At least one of the chambers 20 can be configured as a distribution chamber 21 for the distribution of the heat transfer fluid. At least one of the chambers 20 can be configured as a collection chamber 22 for discharging the heat transfer fluid. The distribution chamber 21 can be connected to an inlet 6 and the collection chamber 22 to an outlet 7. According to the present embodiment, the inlet 6 opens into the distribution chamber 21. The inlet 6 contains a tubular element containing an inlet channel for the heat transfer fluid. According to the present embodiment, the heat transfer fluid leaves the heat exchanger 1 via the outlet 7 which is connected to the collection chamber 22. The outlet 7 contains a tubular element containing an outlet channel for the heat transfer fluid.

According to FIG. 1*a*, the chamber 20 extends from the inlet opening 5 to the outlet opening 8 for the heat transfer fluid, which flows through the jacket element 2 in the operating state. According to this embodiment, a plurality of such chambers 20 extends in a row over at least part of the length of the jacket element 2. The outermost chambers 20 are formed by the distribution chamber 21 and the collection chamber 22. According to this embodiment, the chambers 20 are arranged on the base area and the top area of the jacket element 2. A partition wall 30 is arranged between adjacent chambers 20 so that the heat transfer fluid cannot flow into adjacent chambers. The chambers 20 contain at least one inlet opening 5 and one outlet opening 8 for the heat transfer fluid, which flows through the jacket element 2 in the operating state.

According to this embodiment, the heat transfer fluid flows in the row of web elements 42 and in the row of web elements 44 first in a cross-countercurrent flow and then in a cross-co-current flow to the fluid. The heat transfer fluid flows in the row of web elements 41 and in the row of web elements 43 first in a cross-co-current flow and then in a cross-countercurrent flow to the fluid. According to an embodiment that is not shown, the direction of flow of the heat transfer fluid is reversed, i.e., the positions of the inlet 6 and the outlet 7 are reversed. According to an embodiment not shown, the direction of flow of the fluid is reversed, i.e., the direction of flow of the fluid is opposite to the direction of the arrow.

Figure 1B:
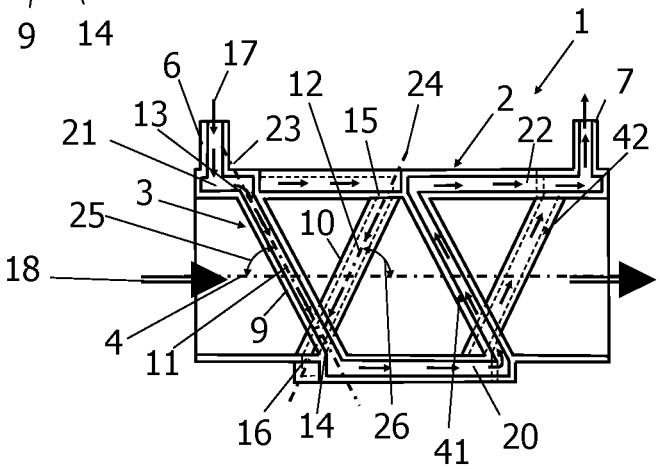

FIG. 1*b* shows a variant of the heat exchanger according to FIG. 1*a* in a sectional view. According to FIG. 1*b*, only a first row of web elements 41 and a second row of web elements 42 are shown, which form the insert element 3. The first row of web elements 41 contains two web elements 9, only one of which is provided with a reference number. The second row of web elements 42 contains two web elements 10, only one of which is provided with a reference number. Each of the web elements 9 includes a web element channel 11 extending from a first end 13 to a second end 14 of the corresponding web element 9. Each of the web elements 10 includes a web element channel 12 extending from a first end 15 to a second end 16 of the corresponding web element 10.

The jacket element 2 contains a plurality of chambers 20, of which only a single chamber 20 is also provided with a reference number. One of these chambers 20 is shown cut open in the sectional view. Two web element channels 11 of two adjacent web elements 9 of the first row of web elements 41 are connected to one another via the chamber 20. Another chamber 20 is shown behind the chamber 20 shown in a sectional view. Two web element channels 12 of two adjacent web elements 10 of the second row of web elements 42 are connected to one another via the further chamber 20. In addition, an inlet 6 and an outlet 7 for a heat transfer fluid 17 are shown in FIG. 1*b*. The direction of flow of the heat transfer fluid 17 through the chambers 20 and the web element channels 11, 12 of the web elements 9, 10 is indicated by arrows in FIG. 1*b*. The direction of flow of a fluid 18, which flows in the fluid channel formed by the jacket element 2, is also marked with arrows.

A distribution chamber 21 and a collection chamber 22 are also shown. In the distribution chamber 21, which is shown partially in section, the heat transfer fluid 17 supplied through the inlet 6 is introduced into the web element channels 11 of the web elements 9 of a first set of web elements and into the web element channels 12 of the web elements 10 of a second set of web elements. The web element channel 11 opens into the chamber 20. The heat transfer fluid 17 flows through the chamber 20 and is introduced into the web element channel 11 of the web element 9 of a further set of web elements parallel to the first set of web elements.

According to FIG. 1*b*, a first and a second set of web elements are provided. The first set of web elements contains the web elements 9 of the first row of web elements 41, the center axes of which each span a common first web element plane. The second set of web elements contains the web elements of the second rows of web elements, the center axes of which span a common second web element plane. One of the first web element planes is shown in FIG. 1*b*. The first web element plane contains the web element central axis 23 of the first web element channel 11 of the web element 9. The web elements of the first set of web elements are aligned parallel to one another, that is to say the web elements of the first set of web elements have the same alignment with respect to one another.

One of the second web element planes is shown in FIG. 1*b*. The second web element plane contains the web element central axis 24 of the second web element channel 12 of the web element 10. The second web element plane is arranged in particular at a second set angle 26 of 30 degrees up to and including 75 degrees to the longitudinal axis 4. The web elements of the second set of web elements are aligned parallel to one another, that is to say the web elements of the second set of web elements have the same alignment with respect to one another.

The alignment of the web elements of the first set of web elements differs from the alignment of the web elements of the second set of web elements. In FIG. 1*b* two first sets of web elements and two second sets of web elements are shown. Of course, any number of first sets of web elements and second sets of web elements can be provided. Each of the first and second sets of web elements may contain a different number of web elements. The number of web elements of each set of web elements can in particular be at least two. Of course, more than two sets of web elements can be provided, with the web elements of each of the sets of web elements having the same orientation with respect one another but having a different orientation to the web elements of each other set of web elements. For example, the web elements of three sets of web elements can be aligned according to FIG. 10 of EP 1 123 730 A2.

Figure 2:
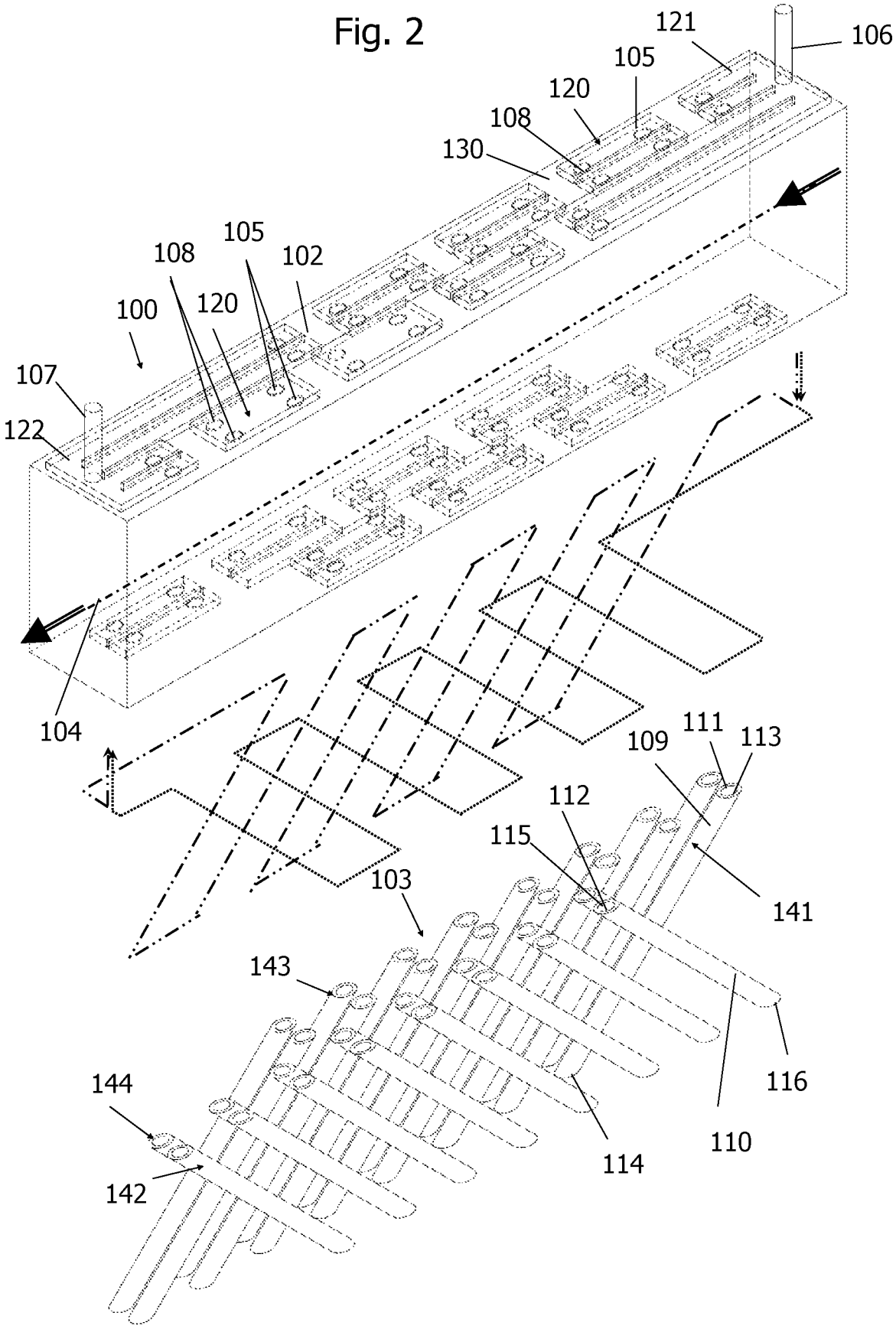
Figure 3:
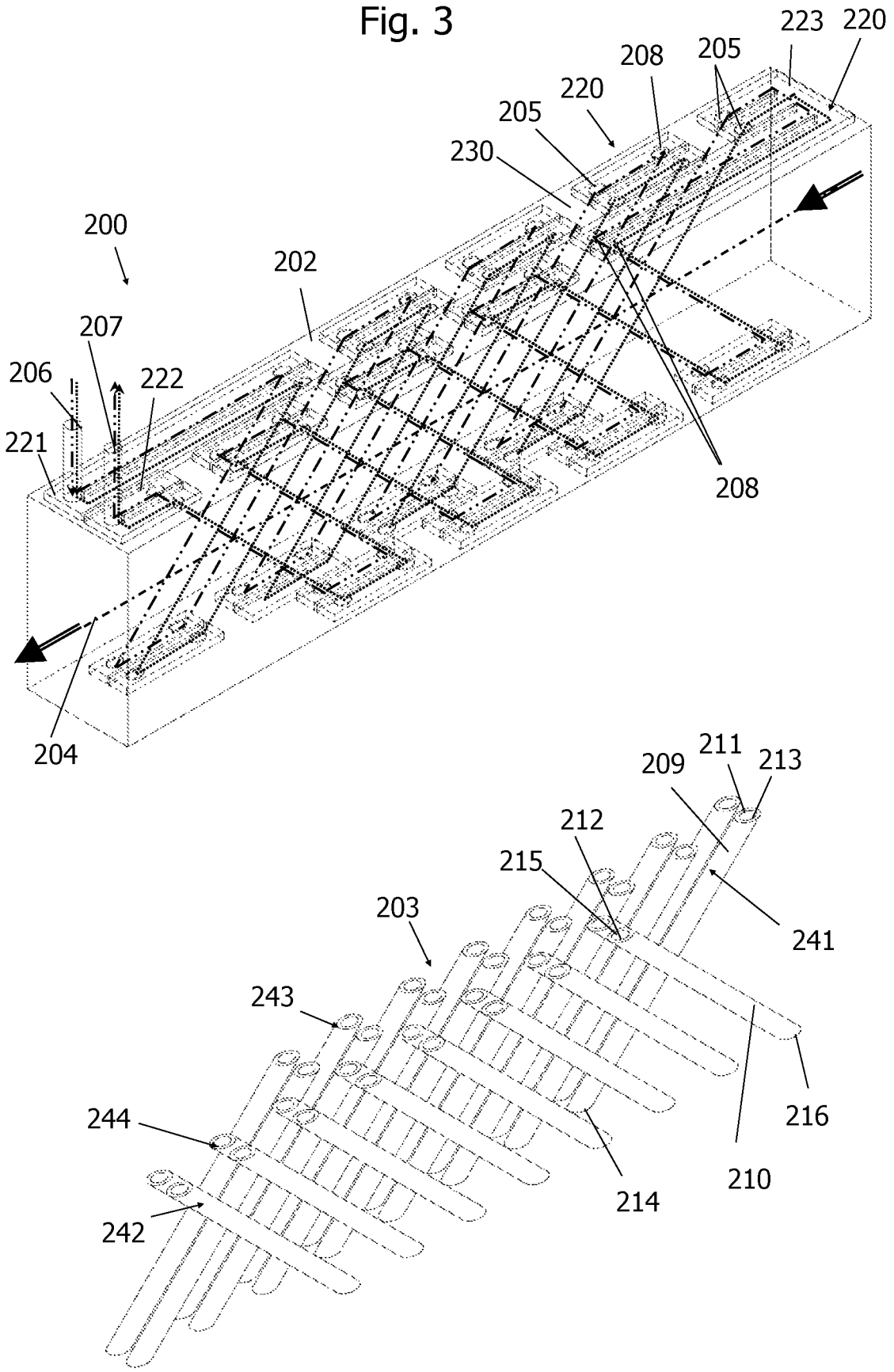

According to the exemplary embodiments shown in FIGS. 1*a*, 2 and 3, eight first sets of web elements and eight second sets of web elements are shown.

FIG. 2 shows a view of a heat exchanger 100 according to a second embodiment of the invention. The heat exchanger 100 according to FIG. 2 comprises a jacket element 102 and an insert element 103. The insert element 103 and the jacket element 102 are drawn separately from one another; in the assembled state, the insert element 103 is located inside the jacket element 102. In the illustration according to FIG. 2, the jacket element 102 is shown as a transparent component, so that all the jacket element channels located in the jacket element 102 are visible. The heat exchanger 100 for static mixing and heat exchange according to FIG. 2 thus contains a jacket element 102 and an insert element 103, the insert element 103 being arranged inside the jacket element 102 in the installed state. The jacket element 102 is partially designed as a hollow body. The insert element 103 is accommodated in the jacket element, i.e., in the hollow body formed by the jacket element 102. The jacket element 102 has a longitudinal axis 104 which extends essentially in the main direction of flow of the fluid which flows through the jacket element 102 in the operating state. A possible direction of flow of the fluid is represented by arrows running in the direction of the longitudinal axis 104. The longitudinal axis 104 runs through the center point of the opening cross-section of the jacket element. According to the present illustration, the jacket element 102 has a rectangular opening cross section. The longitudinal axis 104 thus runs through the intersection of the diagonals of the rectangle.

According to the present embodiment, the insert element 103 contains a plurality of web elements 109, 110. The web elements 109 and the web elements 110 include a different angle of inclination with the longitudinal axis 104. A plurality of web elements 109 are arranged one behind the other in the direction of flow of the fluid and form a first row of web elements 141. A plurality of web elements 110 are arranged one behind the other in the direction of flow of the fluid and form a second row of web elements 142. For the sake of simplicity, reference numerals 109, 110 designate only one of each of the web elements of the corresponding first or second row of web elements 141,142. The insert element 103 shown contains two first rows of web elements 141, 143 and two second rows of web elements 142, 144. According to an embodiment that is not shown, a single first and second row of web elements can be provided. The number of first and second rows of web elements can also be greater than one or two. According to the present embodiment, the first rows of web elements 141, 143 are arranged side by side. The second rows of web elements 142, 144 are also arranged side by side.

Each of the web elements 109 has a first end 113 and a second end 114, with the first end 113 and the second end 114 of the web element 109 being connected to the jacket element 102 at different locations. The web element 109 includes a web element channel 111. Each of the web elements 110 has a first end 115 and a second end 116, with the first end 115 and second end 116 of the web element 110 being connected to the jacket element 102 at different locations. The web element 110 contains a web element channel 112. The web element channels 111, 112 are only partially shown in the present illustration. Such web element channels are already known from EP 2851118 A1 and EP 3489603 A1 or the European patent application EP 20207057.9 published as EP3822569 A1. The web elements disclosed in these documents are to be regarded as examples of a large number of other possible web element shapes. The jacket element 102 according to the invention can be used for any number, arrangement or shape of the web elements. The web element channel 111 extends from the first end 113 of the web element 109 to the second end 114 of the web element 109. The web element channel 112 extends from the first end 115 of the web element 110 to the second end 116 of the web element 110. The web elements 109 can be arranged crosswise to the web elements 110. The web elements 109 can include a first angle of inclination with respect to the longitudinal axis 104. The web elements 110 can include a second angle of inclination with respect to the longitudinal axis 104.

The jacket element 102 contains at least one inlet 106 and one outlet 107 for a heat transfer fluid which flows through the heat exchanger in the operating state. The jacket element 102 is at least partially configured as a hollow body, for example as a double jacket. A plurality of chambers 120 are located in the interior of the jacket element 102. These chambers 120 are traversed by the heat transfer fluid in the operating state. The course of flow of the heat transfer fluid through the jacket element 102 and the insert element 103 within the web element channels 111, 112 is shown in the present illustration by dash-dotted lines with two dots between two adjacent dashes and represented by dashed lines. An exploded view was chosen in FIG. 2 in order to show the chambers 120 in the jacket element. The jacket element 102 can be configured as a double jacket. The double jacket can be formed by an outer shell and an inner shell. The chambers 120 may be formed by partition walls extending between the outer shell and the inner shell. The chambers 120 can also be configured as recesses in the jacket element 102. Alternatively or in combination with the aforementioned embodiments, the chambers 120 can be configured as structures of the jacket element 102.

At least one of the chambers 120 can be configured as a distribution chamber 121 for distribution of the heat transfer fluid. At least one of the chambers 120 can be configured as a collection chamber 122 for discharging the heat transfer fluid. The distribution chamber 121 can be connected to an inlet 106 and the collection chamber 122 to an outlet 107. According to the present embodiment, the inlet 106 opens into the distribution chamber 121. The inlet 106 contains a tubular element containing an inlet channel for the heat transfer fluid. According to the present embodiment, the heat transfer fluid leaves the heat exchanger 100 via the outlet 107, which is connected to the collection chamber 122. The outlet 107 contains a tubular element containing an outlet channel for the heat transfer fluid.

According to FIG. 2, the chamber 120 extends from the inlet opening 105 to the outlet opening 108 for the heat transfer fluid, which flows through the jacket element 102 in the operating state. A plurality of such chambers 120 extend in a row for at least part of the length of the jacket element 102. The outermost chambers 120 are formed by the distribution chamber 121 and the collection chamber 122. According to this embodiment, the chambers 120 are arranged on the base area and the top area of the jacket element 102. A partition wall 130 is arranged between adjacent chambers 120 so that the heat transfer fluid cannot flow into adjacent chambers. The chambers 120 contain at least one inlet opening 105 and one outlet opening 108 for the heat transfer fluid, which flows through the jacket element 102 in the operating state.

Also shown in FIG. 2 are two chambers 120 each containing two inlet openings 105 and two outlet openings 108 each. According to this embodiment, the heat transfer fluid flows in cross-current flow with respect to the fluid. The fluid could also flow in cross-countercurrent flow with respect to the heat transfer fluid, as shown in FIGS. 1*a* and 1*b*.

According to this embodiment, the heat transfer fluid in the row of web elements 142 and in the row of web elements 144 first flows in a cross-countercurrent flow and then in a cross-co-current flow with respect to the fluid. The heat transfer fluid flows in the row of web elements 141 and in the row of web elements 143 first in a cross co-current flow and then in a cross-countercurrent flow to the fluid. According to an embodiment that is not shown, the direction of flow of the heat transfer fluid is reversed, i.e., the positions of the inlet and outlet are reversed. According to an embodiment that is not shown, the direction of flow of the fluid is reversed, i.e., the direction of flow of the fluid is opposite to the direction of the arrow.

FIG. 3 shows a view of a heat exchanger 200 according to a third embodiment of the invention. The heat exchanger 200 according to FIG. 3 comprises a jacket element 202 and an insert element 203. The insert element 203 and the jacket element 202 are drawn separately from one another; in the assembled state, the insert element 203 is located inside the jacket element 202. In this illustration, the jacket element 202 is shown as a transparent component, so that all of the jacket element channels located in the jacket element 202 are visible. The heat exchanger 200 for static mixing and heat exchange according to FIG. 3 thus contains a jacket element 202 and an insert element 203, the insert element 203 being arranged inside the jacket element 202 in the installed state. The jacket element 202 is partially designed as a hollow body. The insert element 203 is accommodated in the jacket element, that is to say in the hollow body. The jacket element 202 has a longitudinal axis 204 which extends essentially in the main flow direction of the fluid which flows through the jacket element 202 in the operating state. A possible direction of flow of the fluid is represented by arrows running in the direction of the longitudinal axis 204. The longitudinal axis 204 runs through the center point of the opening cross-section of the jacket element. According to the present illustration, the jacket element 202 has a rectangular opening cross section. The longitudinal axis 204 thus runs through the intersection of the diagonals of the rectangle.

According to the present embodiment, the insert element 203 contains a plurality of web elements 209, 210. The web elements 209 and the web elements 210 include a different angle of inclination with the longitudinal axis 204. A plurality of web elements 209 are arranged one behind the other in the direction of flow of the fluid and form a first row of web elements 241. A plurality of web elements 210 are arranged one behind the other in the direction of flow of the fluid and form a second row of web elements 242. For the sake of simplicity, reference numerals 209, 210 designate only one of each of the web elements of the corresponding first or second row of web elements 241, 242. The insert element 203 can comprise a plurality of first or second web element rows 241, 242. The insert element 203 shown contains two first rows of web elements 241, 243 and two second rows of web elements 242, 244. According to an embodiment that is not shown, a single first and second row of web elements can be provided. The number of first and second rows of web elements can also be greater than one or two. According to the present embodiment, the first rows of web elements 241, 243 are arranged side by side. The second rows of web elements 242, 244 are also arranged side by side.

Each of the web elements 209 has a first end 213 and a second end 214, with the first end 213 and the second end 214 of the web element 209 being connected to the jacket element 202 at different locations. The web element 209 includes a web element channel 211. Only the inlet opening of the web element channel 211 is shown in the present illustration. Each of the web elements 210 has a first end 215 and a second end 216, with the first end 215 and the second end 216 of the web element 210 being connected to the jacket element 202 at different locations. The web element 210 contains a web element channel 212. Only the outlet opening of the web element channel 212 is shown in the present illustration. Such web element channels are already known from EP 2851118 A1 and EP 3489603 A1 or the European patent application EP 20207057.9 published as EP3822569 A1. The web elements disclosed in these documents are to be regarded as examples of a large number of other possible web shapes. The jacket element 202 according to the invention can be used for any number, arrangement or shape of the web elements. The web element channel 211 extends from the first end 213 of the web element 209 to the second end 214 of the web element 209. The web element channel 212 extends from the first end 215 of the web element 210 to the second end 216 of the web element 210.

The web elements 209 can be arranged crosswise to the web elements 210. The web elements 209 can include a first angle of inclination with respect to the longitudinal axis 204. The web elements 210 can include a second angle of inclination with respect to the longitudinal axis 204.

The jacket element 202 contains at least one inlet 206 and one outlet 207 for a heat transfer fluid which flows through the heat exchanger in the operating state. The jacket element 202 is at least partially configured as a hollow body, for example as a double jacket, i.e., a plurality of chambers 220 are located inside the jacket element 202. Heat transfer fluid flows through these chambers 220 in the operating state. The course of flow of the heat transfer fluid through the jacket element 202 and the insert element 203 within the web element channels 211, 212 is shown in the present illustration by dash-dotted lines with two dots between two adjacent dashes for the flow through the rows of web elements 243 and 244 and is shown by dashed lines for the flow through the rows of web elements 241 and 242. An exploded view was chosen in FIG. 3, according to which the insert element 203 is arranged outside the jacket element 202 in order to show the chambers 220 in the jacket element. The jacket element 202 can be configured as a double jacket. The double jacket can be formed by an outer shell and an inner shell. The chambers 220 may be formed by partition walls extending between the outer shell and the inner shell. The chambers 220 can also be configured as recesses in the jacket element 202. Alternatively or in combination with the aforementioned embodiments, the chambers 220 can be configured as structures of the jacket element 202.

At least one of the chambers 220 can be configured as a distribution chamber 221 for distribution of the heat transfer fluid. At least one of the chambers 220 can be configured as a collection chamber 222 for discharging the heat transfer fluid. The distribution chamber 221 can be connected to an inlet 206 and the collection chamber 222 to an outlet 207. According to the present embodiment, the inlet 206 opens into the distribution chamber 221. The inlet 206 contains a tubular element containing an inlet channel for the heat transfer fluid. According to the present embodiment, the heat transfer fluid leaves the heat exchanger 200 via the outlet 207, which is connected to the collection chamber 222. The outlet 207 contains a tubular element containing an outlet channel for the heat transfer fluid.

According to FIG. 3, the chamber 220 extends from the inlet opening 205 to the outlet opening 208 for the heat transfer fluid, which flows through the jacket element 202 in the operating state. According to this embodiment, a plurality of such chambers 220 extends in a row over at least part of the length of the jacket element 202. The outermost chambers 220 are formed by the distribution chamber 221 and the collection chamber 222 at one end of the jacket element, in FIG. 3 the outlet end for the fluid. According to this embodiment, the chambers 220 are arranged at the base area and the top area of the jacket element 202. A partition wall 230 is arranged between adjacent chambers 220 so that the heat transfer fluid cannot flow into adjacent chambers. The chambers 220 contain at least one inlet opening 205 and one outlet opening 208 for the heat transfer fluid, which flows through the jacket element 202 in the operating state.

Also shown in FIG. 3 is a chamber 220 containing two inlet openings 205 and two outlet openings 208 each. In the present illustration, this chamber 220 is arranged at the inlet end of the jacket element 202. This chamber 220 is configured as a deflection chamber 223. According to this embodiment, the heat transfer fluid first flows in a cross-countercurrent and then in a cross-co-current flow to the fluid. The heat transfer fluid could also first flow in a cross-co-current flow and then in a cross-countercurrent flow to the fluid if either the flow direction of the heat transfer fluid or the flow direction of the fluid is reversed.

According to each of the preceding embodiments, the web elements can be connected to the jacket element by gluing, soldering, casting, an additive manufacturing process, welding, clamping, shrinking or combinations thereof. Gluing, soldering or welding can be performed from the inside and/or from the outside. In particular, the jacket element and the web elements can be formed in one piece. According to an embodiment, the web element channel can be free from kinks. According to an embodiment, the web element channel can transition into the chamber without kinks.

The web element channels in the web elements extend from the first end to the second end of the web element, which directly adjoins the inner wall of the jacket element. According to an embodiment, there is an opening in the jacket element, which opening can be configured as an inlet opening or outlet opening. The opening has at least the same cross-sectional area as the cross-sectional area of the web element channel adjoining the opening.

At least a portion of the web elements thus extends over the entire width dimension or height dimension or the average diameter of the jacket element. The mean diameter corresponds to the inner diameter of the jacket element when the jacket element is configured as a circular tube. The mean diameter for an angular jacket element is defined as its perimeter/$\pi$ (pi), corresponding to an equivalent diameter. In particular, the length of the web element channel can be at least 10% greater than the mean diameter when the web element channel crosses the central axis. The length of this web element channel can in particular be at least 20% greater than the mean diameter, particularly preferably at least 30% greater than the mean diameter.

The dimensions of a web element are determined by its length, width and thickness. The length of the web element is measured from the first end of the web element to the second end of the web element. The length of the web element channel essentially corresponds to the length of the web element.

The width of the web element is essentially measured transversely to the direction of flow. That is, the width extends substantially in a plane perpendicular to the length of the web element and showing the cross section of the web element. The cross section of the web element is characterized by its width and its thickness. The length of at least the longest web element is at least 5 times as great as its width.

The width of the web element is 0.5 up to and including 5 times its thickness, advantageously 0.75 up to and including 3 times its thickness. If the width of the web element is 1 to 2 times as large as its thickness, a particularly preferred range results for which particularly good cross-mixing can be achieved. The width of the web element is defined as the normal distance extending from the first edge and the second edge of the web element on the upstream side. The width of the web element on the upstream side can differ from the width measured on the downstream side of the web element.

An edge is understood to mean the edge of the web element against and around which the fluid flows, wherein the edge extends essentially parallel to the length of the web element. The thickness of the web element can be variable. The minimum thickness is less than 75% and advantageously less than 50% less than the maximum thickness. The variations can be caused, for example, by ribs, indentations, nubs, wedge-shaped webs or some other shape variation or an unevenness.

The web element can be characterized in that flat surfaces, convex or concave surfaces are present in the direction of flow, which present a contact surface for the flowing fluid. These surfaces aligned in the direction of flow result in an increased downstream resistance, in particular in comparison with a tubular element, which can result in an improved heat transfer.

The web element channel, which runs inside the web element, preferably has an inner diameter which corresponds to a maximum of 75% of the thickness of the web element. In principle, a plurality of web element channels, in particular running essentially parallel, can also be contained in a web element.

The transition from at least one of the first and second ends of the web element to the jacket element advantageously takes place without a gap. According to an embodiment, the web elements and the jacket element therefore consist of a single component, which is preferably manufactured by a casting process. A smooth transition from the web element to the jacket element is a characteristic of the property that the transition is gap-free. In particular, curves can be provided at the edges in the transition area from the web element to the jacket element, so that the flow of the castable material is not impaired during the manufacturing process. The web element channels run inside the web elements, so that there is no connection between the channels inside the web elements and the space surrounding the web elements.

In a casting process, a monolithic structure is produced, at least in segments, consisting of sets of web elements arranged at an angle other than zero relative to the main direction of flow and a jacket element which is firmly connected to at least some of the web elements and which can be configured as a jacket tube. Instead of a casting process, an additive manufacturing process can also be used.

Alternatively, there is also the possibility that the openings of the jacket element match the outer contour of the web element. According to this embodiment, the web element can be pushed through the opening of the jacket element and thus positioned in the interior of the jacket element. According to this embodiment, the web element can be connected to the jacket element by gluing, soldering, welding, clamping, pressing in, or shrinking.

The web element channels for the heat transfer fluid in the web elements can be manufactured by the casting process described earlier or by an additive manufacturing method. However, the web element channels can also be produced by subsequent processing such as eroding or drilling. A heat transfer fluid can include any liquid, such as water or oils, but also a gas, such as air.

The web elements can be arranged at an angle of approximately 25 up to and including 75 degrees, in particular at an angle of approximately 30 up to and including 60 degrees, to the direction of main flow. The web elements can form sets of web elements, wherein the set of web elements contains web elements which are arranged parallel to one another and whose central axes lie in a common plane. The central axes of the web elements form the line of intersection of the common plane of the set of web elements with the common plane of the corresponding set of web elements. The web elements of a set of web elements can be located in a common group plane. According to an embodiment, the first and second group planes intersect. According to a further embodiment, a web element of the first set of web elements adjoins a web element of the second set of web elements. According to this embodiment, adjacent web elements therefore have a different orientation, since they belong to different sets of web elements, which corresponds to the arrangement of the web elements according to FIGS. 1*a* and 1*b*. According to the embodiments illustrated in FIGS. 2 and 3, adjacent web elements of the sets of web elements 141, 241 and 143, 243 or adjacent web elements of the sets of web elements 142, 242 and 144, 244 have the same orientation, since they each belong to the same set of web elements.

According to an embodiment, web elements of different sets of web elements intersect, since an improved heat exchange can be achieved in this way. The angle between two intersecting web elements is advantageously 25 up to and including 75 degrees. Any number of web elements can be arranged one behind the other in each of the rows of web elements. The maximum number rows of web elements lying next to one another in the jacket element is determined by the width dimension of the jacket element. The row of web elements is characterized in that the central axes of all web elements lie in essentially the same plane of the row. In particular, 6 up to and including 40 web elements, for example 6 up to and including 30 web elements, are arranged parallel to one another in a row of web elements. According to the present embodiment, 8 web elements are arranged in a row of web elements as an example. According to the exemplary embodiments, two web elements are arranged in a set of web elements of each of the 8 sets of web elements.

Any number of web elements can be arranged one behind the other in the row of web elements, viewed in the main direction of flow. The web elements arranged one behind the other are advantageously arranged in such a way that they overlap in order to accommodate as much active heat exchange surface as possible in a small apparatus volume. Overlapping means that at least some of the web elements of a first set of web elements and some of the web elements of a subsequent set of web elements and/or a preceding set of web elements are arranged in the same tube section, seen in the main direction of flow. The projection of the length of the web element on the longitudinal axis results in a length L1 and the projection of the overlapping part of the web elements of the adjacent set of web elements on the longitudinal axis results in a length L2, wherein L2 is less than L1 and L2 is greater than 0. The tube section under consideration is defined in such a way that it has the length L1, i.e., it extends from a centrally arranged web element from its first end to its second end in the projection onto the longitudinal axis.

Since the mixing effect in identically aligned sets of web elements arranged one behind the other only takes place in one plane, after a certain number of sets of web elements the alignment can be changed in such a way that the sets of web elements are advantageously offset from one another. In particular, two up to and including 20 rows of web elements are provided, particularly preferably 4 up to and including 8 rows of web elements. The displacement between the sets of web elements that are aligned in the same way is advantageously carried out by an angle of 80 up to and including 100 degrees. This means that the second set of web elements is offset about an angle of 80 up to and including 100 degrees in relation to the first set of web elements with the angle being measured around the longitudinal axis.

In addition to the above-described sets of intersecting web elements, sets of web elements containing web elements that only extend from the inner wall of the jacket element to the intersection line with the other set of web elements can also be provided, especially in the end portion of parallel sets of web elements that are aligned in the same way. These sets of web elements are referred to as half intersecting sets of web elements. These sets of web elements lead to an additional increase in mixing performance. Due to the better mixing effect and the additional heat conduction effects of the web element material, the heat exchange is additionally increased as well.

According to an embodiment, the web elements can form a first and a second set of web elements. Each of the first and second sets of web elements can span a first or second group plane. In particular, the first group plane of the first set of web elements can intersect with the second group plane of the second set of web elements in such a way that a common intersection line is formed, which has an intersection with the longitudinal axis or runs essentially transversely to the longitudinal axis and/or in a perpendicular plane to the intersection line, which contains the longitudinal axis or has a minimum distance from the longitudinal axis. According to an embodiment, at least one set of web elements can be provided, which extends essentially up to the intersection line. The web elements in a first and second set of web elements may touch one another or have gaps between them. It is also possible to connect the intermediate spaces with connecting webs arranged transversely to the direction of fluid flow.

Heat transfer fluid can also flow through different sections or segments of the heat exchanger through separate jacket channels, so that the heat exchanger contains different sections or segments through which heat transfer fluid of different temperatures can flow. This allows a different temperature control in the individual segments. It has been shown that for high heat transfer in a small apparatus volume with jacket element diameters of 60 mm and more, the heat transfer fluid should flow through at least half of all web elements.

It has been shown that a casting method, an additive manufacturing method, a soldering method, an adhesive method, a shrinking method, a clamping method and a welding method can be cost-effective manufacturing methods for web elements and a jacket element monolithically connected to the web elements without a gap. The insert element, comprising the sets of web elements with the corresponding web elements, can be manufactured in one piece. Alternatively, the insert element can consist of individual segments that are subsequently connected, for example by welding or screwed flange connections or by bracing. Furthermore, the outer geometry of the web elements and the web element geometry as well as the geometry of the web element channels for the heat transfer fluid can be easily decoupled for a welding process as well as for a casting process. For example, rectangular profiles can advantageously be used for the outer geometry of the web elements and the web element channel geometry can advantageously be selected as a circumferential cross section, i.e., in particular a circular or oval cross section. Therefore, web elements with an ideal profile for cross-mixing and/or high inherent strength can be produced for large maximum fluid pressures. It has been shown that the web element channels for the heat transfer fluid in the web elements are advantageously produced after the casting process by eroding and even more advantageously by drilling, so that web element channels with small diameters can also be produced.

It has also been shown that with the sets of web elements according to the invention and especially with sets of web elements in which adjacent web elements intersect and/or especially with overlapping groups of web elements, a very good heat transfer and/or a high mixing performance can be obtained. In particular, the arrangement of a second set of web elements, which is offset by 80 up to and including 100 degrees with respect to the first set of web elements, can be beneficial for good heat transfer. Surprisingly, it has also been shown that a further improvement in the heat transfer and/or the mixing performance can be achieved specifically by attaching additional chambers and specifically in the case of viscous fluids.

The heat transfer and/or the mixing performance in the vicinity of the inner wall of the jacket element is also significantly improved by the direct transition of the web elements into the jacket element, since boundary layers of the fluid located on the inner wall are also involved in achieving optimal heat transfer or a homogeneous mixture. In particular, not only an optimal renewal of the boundary layers between the fluid and the jacket element, but also between the fluid and the web element surface can be generated. Optimal boundary layer renewal therefore leads to optimal use of the heat exchange surface. The optimal use of the heat exchange surface also means that the heat exchanger for a given cooling or heating task can be built with an even smaller apparatus volume and with a lower pressure drop.

Due to the optimized heat transfer, the heat exchanger according to the invention shows a very narrow range of residence times for the fluid to be heated or cooled. As a result, deposits or a decomposition of fluid can be prevented in the best possible way. For cooling tasks that involve the cooling of a viscous fluid, such as a polymer, a very low melt temperature close to the glass transition point can be achieved due to the optimal renewal of the boundary layers. In particular, the deposit of solidified polymer on the heat exchange surfaces is avoided.

The direct transition of the individual web elements into the jacket element and the use of the chambers for the heat transfer fluid that covers as much area as possible also leads to a stable construction that is also suitable for operation with high fluid operating pressures. As a result, the heat exchanger according to the invention can be built very compactly, especially for operation with viscous fluids. The heat exchanger is basically suitable for mixing and cooling or heating any fluids such as liquids and gases, but especially for viscous and very viscous fluids such as polymers.

The jacket element and the insert element can contain castable or weldable materials, for example, metals, ceramics, plastics or combinations of these materials can be used.

A method for manufacturing a heat exchanger, which contains an insert element and a jacket element, wherein the insert element is provided with at least one web element arranged at an angle other than zero relative to the main direction of flow and a jacket element firmly connected to the web element, comprises the following method steps. The web element and the insert jacket element are produced by an adhesive method, a soldering method, a casting method, an additive manufacturing method, a welding method, a clamping method or a shrink-fitting method or combinations thereof. The web element contains a web element channel, which is produced by the casting process or an additive manufacturing process together with the insert jacket element or is produced in a further work step by means of a drilling process or an eroding process.

As described in EP3489603 A1, an intermediate jacket element can also be arranged between the insert element and the jacket element, wherein th intermediate jacket element contains a first intermediate jacket element channel and a second intermediate jacket element channel, the intermediate jacket element being positioned in the jacket element and the insert element being positioned in the intermediate jacket element in such a way that the heat transfer fluid may flow from the jacket element channel through the first intermediate jacket element channel into the web element channel, flow through the web element channel, and flow from the web element channel through the second intermediate jacket element channel into the jacket element channel.

The use of an intermediate jacket element has several advantages. In this way, the insert element can be made significantly thinner and lighter. A different material, for example a higher quality material, can therefore be used for the insert element than for the intermediate jacket element. In particular, the insert element can contain a material of high thermal conductivity or high resistance to chemicals, for example corrosion resistance. The insert element can be manufactured in one piece together with the web elements by an additive manufacturing process or a casting process. Since the production of the insert element is very complex, it can be stored as a semi-finished product and the intermediate jacket element can be adapted to the required wall thickness depending on the application and the nominal pressure. The jacket element, which surrounds the intermediate jacket element, can be configured as a further double jacket, through which the heat transfer fluid flows in the operating state. The heat transfer fluid passes through the openings in the jacket element and in the intermediate jacket element as well as in the insert jacket element to at least one of the web elements, so that it can flow through the web element or elements.

The invention is not limited to the present embodiments. The web elements can differ in their number and in their dimensions. Furthermore, the number of web element channels in the web elements can differ depending on the required heat requirement for the heat transfer. The angle of inclination which the groups or sets of web elements enclose to the longitudinal axis can also vary depending on the application. More than two insert elements can also be arranged one behind the other.

It is obvious to a person skilled in the art that many further variants are possible in addition to the embodiments described without departing from the inventive concept. The subject matter of the invention is therefore not restricted by the preceding description and is determined by the scope of protection which is defined by the claims. The broadest possible reading of the claims is authoritative for the interpretation of the claims or the description. In particular, the terms "contain" or "include" are to be interpreted in such a way that they refer to elements, components, or steps in a non-exclusive meaning, which is intended to indicate that the elements, components, or steps can be present or are used that they can be combined with other elements, components or steps that are not explicitly mentioned. When the claims relate to an element or component from a group which may consist of A, B, C to N elements or components, this formulation should be interpreted in such a way that only a single element of that group is required, and not combination of A and N, B and N, or any other combination of two or more elements or components of this group.

The invention claimed is:

1. A heat exchanger comprising a jacket element and an insert element, wherein the jacket element is configured as a fluid channel for a fluid to be tempered, wherein the jacket element comprises a longitudinal axis, wherein the insert element is arranged in the fluid channel, wherein the insert element contains a plurality of web elements which are connected to the jacket element at different locations, wherein the plurality of web elements are arranged in at least a first row of the plurality of web elements and a second row of the plurality of web elements, wherein the plurality of web elements of each of the first and second rows of the plurality of web elements are arranged essentially parallel to one another, wherein angles which the plurality of web elements of different rows of web elements enclose with the longitudinal axis of the jacket element differ, wherein at least some of the plurality of web elements contain web element channels which are fluidly connected with the jacket element, so that in an operating state a heat transfer fluid which is supplied to the jacket element can flow through the web element channels of the plurality of web elements, wherein the jacket element contains a plurality of chambers for the heat transfer fluid, wherein each of the plurality of chambers of the jacket element contains at least one inlet opening and at least one outlet opening for the heat transfer fluid or is configured as a distribution chamber or as a collection chamber, wherein the at least one inlet opening and the at least one outlet opening of at least one of the plurality of chambers of the jacket element are connected to the web element channels of two web elements of the insert element each, which belong to a same row of the plurality of web elements and the distribution chamber or the collection chamber in the jacket element comprises one opening being connected to a respective web element channel of the insert element, and wherein at least one of the plurality of chambers of the jacket element comprises at least two inlet openings and at least two outlet openings for the heat transfer fluid.

2. The heat exchanger of claim 1, wherein each of the plurality of chambers are separated from one another by partition walls.

3. The heat exchanger of claim 1, wherein each of the plurality of chambers is fluidly connected for the heat transfer fluid via the web element channels with at least one subsequent chamber.

4. The heat exchanger of claim 1, wherein the distribution chamber is configured for distributing the heat transfer fluid and the collection chamber is configured for discharging the heat transfer fluid, wherein the distribution chamber is connectable to an inlet and the collection chamber is connectable to an outlet.

5. The heat exchanger of claim 1, wherein a number of inlet openings of the web element channels opening into one chamber of the plurality of chambers corresponds to a number of outlet openings of the web element channels leading away from the one chamber.

6. The heat exchanger of claim 1, wherein the distribution chamber and the collection chamber are each located at opposite ends of the jacket element.

7. The heat exchanger of claim 1, wherein the distribution chamber and the collection chamber are located at a same end of the jacket element.

8. The heat exchanger of claim 1, wherein at least four first rows of the plurality of web elements and four second rows of the plurality of web elements are arranged side by side.

9. The heat exchanger of claim 1, wherein at least one of the first or second rows of the plurality of web elements contains at least ten web elements.

10. The heat exchanger of claim 1, wherein the plurality of chambers are formed as recesses or structures in the jacket element.

11. The heat exchanger of claim 1, wherein the at least one inlet opening and the at least one outlet opening, which are located in a same chamber of the plurality of chambers, are fluidly connected to the web element channels, which belong to the plurality of web elements of different rows of web elements.

12. A method for tempering a fluid, wherein the fluid is tempered by a heat exchanger, wherein the heat exchanger comprises a jacket element and an insert element, wherein the fluid flows in a fluid channel enclosed by the jacket element, wherein the insert element is arranged in the fluid channel, wherein the insert element contains a plurality of web elements which are connected to the jacket element at different locations, wherein the plurality of web elements are arranged in at least a first row of the plurality of web elements and a second row of the plurality of web elements, wherein the plurality of web elements of each of the first row of the plurality of web elements and the second row of the plurality of web elements are arranged essentially parallel to one another, wherein angles which the plurality of web elements of different rows of web elements enclose with a longitudinal axis of the jacket element differ, with at least some of the plurality of web elements of the insert element having web element channels which are fluidly connected with the jacket element, so that in an operating state a heat transfer fluid which is supplied to the jacket element can flow through the web element channels of the plurality of web elements of the insert element, wherein the jacket element contains a plurality of chambers for the heat transfer fluid, wherein each of the plurality of chambers of the jacket element has at least one inlet opening and at least one outlet opening for the heat transfer fluid, so that the heat transfer fluid flows through each of the plurality of chambers of the jacket element and the web element channels of the insert element, and wherein at least one of the plurality of chambers of the jacket element comprises at least two inlet openings and at least two outlet openings for the heat transfer fluid.

13. The method of claim 12, wherein at least one of the inlet opening or the at least one outlet opening of different chambers of the plurality of chambers is connected to one another via web elements which run through the fluid channel, so that a heat transfer takes place between the heat transfer fluid and the fluid via an inner wall of the jacket element and the plurality of web elements when the heat transfer fluid flows through the plurality of chambers and the web element channels of the plurality of web elements.

14. The method of claim 12, wherein the heat transfer fluid flows from an outlet opening of one of the plurality of chambers to an inlet opening of a respectively following chamber through one of the web element channels, which is arranged in one of the plurality of web elements arranged in the fluid channel, so that the heat transfer fluid flows through the plurality of chambers sequentially, wherein the plurality of chambers are connected to one another via one of the first or second rows of the plurality of web elements.

15. The method of claim 12, wherein the heat transfer fluid flows from an outlet opening in one of the plurality of chambers to an inlet opening in a respectively following chamber of the plurality of chambers through one of the web element channels, which is arranged in one of the plurality of web elements, which is arranged in the fluid channel, so that the heat transfer fluid flows through the web element channels of the plurality of web elements of an associated web element row sequentially.

* * * * *